US009929003B2

(12) United States Patent
McAlister

(10) Patent No.: US 9,929,003 B2
(45) Date of Patent: Mar. 27, 2018

(54) ION SOURCE FILTER

(71) Applicant: Thermo Finnigan LLC, San Jose, CA (US)

(72) Inventor: Graeme C. McAlister, San Jose, CA (US)

(73) Assignee: THERMO FINNIGAN LLC, San Jose, CA (US)

( * ) Notice: Subject to any disclaimer, the term of this patent is extended or adjusted under 35 U.S.C. 154(b) by 0 days.

(21) Appl. No.: 15/163,516

(22) Filed: May 24, 2016

(65) Prior Publication Data

US 2016/0358765 A1 Dec. 8, 2016

Related U.S. Application Data

(60) Provisional application No. 62/171,113, filed on Jun. 4, 2015.

(51) Int. Cl.

*H01J 49/42* (2006.01)
*H01J 49/10* (2006.01)
*H01J 49/06* (2006.01)

(52) U.S. Cl.

CPC ..... *H01J 49/4215* (2013.01); *H01J 49/063* (2013.01)

(58) Field of Classification Search

CPC .... H01J 49/4215; H01J 49/063; H01J 49/421; H01J 49/10
USPC ..... 250/281, 282, 283
See application file for complete search history.

(56) References Cited

U.S. PATENT DOCUMENTS

2007/0164213 A1* 7/2007 Javahery ..... H01J 49/066 250/292
2014/0284469 A1* 9/2014 Langridge ..... H01J 49/063 250/282

FOREIGN PATENT DOCUMENTS

GB 2497799 A 6/2013
WO 03/065403 A2 8/2003

OTHER PUBLICATIONS

Hogan, et al., "Performance Simulation of a Quadrupole Mass Filter Operating in the First and Third Stability Zones", IEEE Transactions on Instrumentation and Measurement (2008), 57, (3), pp. 498-508.

* cited by examiner

*Primary Examiner* — Nicole Ippolito
(74) *Attorney, Agent, or Firm* — Charles B. Katz

(57) ABSTRACT

An ion source filter for use in the source region is disclosed. The ion source filter includes four rod electrodes having circular cross sections. The rod electrodes of the ion source filter are sized and positioned such that the ratio $r/r_0$ of the rod radius to the inscribed circle radius is considerably reduced relative to conventional RF/DC mass filters. The reduced $r/r_0$ geometry has been observed to lessen the diminishment of resolution with increasing pressure relative to prior art devices.

11 Claims, 4 Drawing Sheets

160

ION SOURCE FILTER

CROSS-REFERENCE TO RELATED APPLICATIONS

This application claims the priority benefit of U.S. provisional patent application No. 62/171,113 for "Ion Filter for Mass Spectrometer" by Graeme McAlister, filed Jun. 4, 2015, the disclosure of which is incorporated by reference.

FIELD OF THE INVENTION

The present invention relates generally to mass spectrometry, and more particularly to a quadrupole mass filter for selectively removing undesired ions from an ion beam.

BACKGROUND OF THE INVENTION

Recent trends in mass spectrometer design have included the development of "brighter" ion sources capable of generating and delivering large numbers of ions to downstream components of the mass spectrometer for mass analysis. Improvements in ion sources have included high-throughput ion transfer tubes, which possess higher gas conductances relative to prior designs while maintaining adequate heat transfer for evaporation of residual solvent, and radio-frequency (RF) optics located within the source regions, such as ion funnels or S-lenses, which enable effective focusing of ions to an axial centerline. While these and other improvements have produced significant benefits in terms of increased instrument sensitivity (e.g., the ability to detect and measure ever smaller quantities of analytes), the use of brighter ion beams has the disadvantage of causing fouling of mass spectrometer components more quickly relative to predecessor designs. As the surfaces of these components become contaminated, charging and other operational problems arise, eventually requiring the instrument to be cleaned to restore its performance. The need to frequently clean the components of a mass spectrometer increases instrument downtime and is thus disfavored, particularly since the cleaning procedure typically requires that the vacuum chambers be vented to atmosphere, in turn necessitating a lengthy pump-down period before the instrument may again be used for sample analysis.

In order to alleviate the contamination problem associated with brighter ion sources, and to decrease the frequency at which cleaning must be performed, some instruments (e.g., the Q Exactive Plus mass spectrometer available from Thermo Fisher Scientific) have incorporated ion filtering strategies in which unwanted ions are rejected early in the ion pathway. Referring initially to FIG. 1, which symbolically depicts components in the source region of a mass spectrometer, a heated capillary (alternatively referred to as an ion transfer tube) 110 extends between an atmospheric pressure region and a first vacuum region 120 operated at reduced pressure. A not-depicted electrospray ionization (ESI) or atmospheric-pressure chemical ionization (APCI) source located in the atmospheric-pressure region may be employed to generate ions from a sample (e.g., the eluate of a liquid chromatograph). A portion of the ions thus formed enter the front end of the ion transfer tube and are conveyed through the tube by gas dynamic (and/or electrostatic) forces. Ion transfer tube 110 may be heated so as to evaporate residual liquid solvent. Ions, together with background gas, leave the ion transfer tube through the back end thereof as a free jet that expands into first vacuum region 120. An ion funnel 130 may be employed to focus the ions to an axial flow centerline while permitting the removal of gas through a vacuum pump port. As is known in the art, ion funnel 130 consists of a stacked ring ion guide having apertures of progressively smaller dimension in the direction of ion flow, with RF voltages applied in alternating phases to successive ring electrodes to generate an RF field that urges ions toward the axial centerline. Alternative structures, such as an S-lens (a stacked ring ion guide having longitudinal spacing between ring electrodes increasing in the flow direction) may be used in place of the ion funnel.

The vacuum pressures in the first and second vacuum regions 120 and 140 may be established and controlled via the use of a set of vacuum pumps (typically including a combination of mechanical pumps and/or turbomolecular pumps) that communicates with the vacuum regions via respective ports.

Downstream of ion funnel 130 (or other optic) is a lens 150 that divides first vacuum region 120 from second vacuum region 140. Lens 150 has a conductance-limited aperture that permits the second vacuum region to be maintained at a lower pressure than the first vacuum region. Located inside second vacuum region 140 is a short (relative to conventional quadrupole mass filters used as mass analyzers) RF/DC ion guide 160, alternately referred to herein as a pre-filter or source filter. In this particular configuration, source filter 160 is comprised of four elongated rod electrodes. Following this source filter is another lens 170 having a conductance-limited aperture. The second lens of the mass spectrometer source region can be followed by many possible mass spectrometer configurations, comprising ion guides, mass analyzers, collision cells, lenses, etc.

To enable filtering of ions based on their mass-to-charge ratio (m/z), a voltage source (not depicted) is configured to apply oscillatory (i.e., radio-frequency (RF)) and resolving DC voltages to the rod electrodes. In this implementation, an RF voltage with a low amplitude (to avoid breakdown and consequent arcing in the relatively high-pressure vacuum regions) and a high frequency (to facilitate ion focusing) is applied to the electrodes of source filter 160. Ion trajectories are often described as stable or instable based upon their location on the Mathieu stability diagram. Based upon the electric fields applied to source filter 160 (i.e., low RF amplitude and high frequencies), the ions will tend to reside at very low q-values on the Mathieu stability diagram while they are in the source filter region. As such, source filter 160 will be practically limited to acting as a low-pass ion filter.

The environmental conditions in the source region of the mass spectrometer deviate substantially from what is typically found in a vacuum chamber containing a conventional quadrupole mass filter mass analyzer. In the embodiment depicted in FIG. 1 and described above, both the vacuum pressure in the source region and the physical space available constrain the performance of source filter 160. Depending upon the vacuum pumps on the system, the size of the gas conductance limits (e.g., the apertures size of lenses 150 and 170), and the gas flow rate through the heated capillary, the pressure in second vacuum region 140 can vary from a few mTorr to greater than 100 mTorr. Also, the need to limit the instrument footprint, in conjunction with the differential pumping requirements in the source region, work together to constrain the length of the RF/DC ion guide in second vacuum region 140 (typically to less than 30 mm).

High-quality quadrupole mass filters may be constructed from four elongated rod electrodes having truncated hyperbolic surfaces facing the ion flow centerline. This geometry minimizes departures from an ideal purely quadrupolar field that adversely impact device performance. As a lower cost alternative, four round rod electrodes (cylindrical electrodes having circular cross-sections) are often substituted for the hyperbolic rods. The arrangement of cylindrical rod electrodes to form a quadrupole mass filter is depicted in perspective view in FIG. 2. The rod electrodes extend parallel to an axial centerline 210 between an inlet end 220 that accepts ions to be filtered and an outlet end 230 from which the selectively transmitted ions exit the mass filter. FIG. 3, which shows a cross-sectional view of the quadrupole mass filter taken through a lateral plane (labeled as A-A in FIG. 2) directed transverse (i.e., perpendicular) to axial centerline 210, shows that each rod electrode (labeled 310*a-d*) is positioned at a distance $r_0$ from the axial centerline (this distance $r_0$ being referred to as the inscribed radius), and that the rods are arranged in two pairs, with each pair being aligned to and opposed across the centerline such that the centers of the rod cross-sections define the vertices of a square. The rods may be of equal cross-sectional radii r. Though these simpler, non-ideal rod geometries are easier to construct, they can introduce higher order multipole fields (e.g., A6 and A10 field components) that may hamper filter performance. A number of references in the mass spectrometry literature have sought to identify an optimal value of the ratio ($r/r_0$) between the radius of the rods and the radius of the inscribed circle defined by the inner surfaces of the rods that minimizes the magnitude and overall effect of these higher order multipole potentials. Depending upon how this "optimal" ratio is determined, the value tends to fall between 1.14 and 1.16, and virtually all of the commercially available round-rod quadrupole mass filters have geometries that fall within this range.

The performance of the source filter in the source region is closely tied to the pressures in those vacuum chambers. By adjusting the throughput of the vacuum pumps, it is possible to vary the pressures in these vacuum regions. Measurements of the transmission profile of an exemplary ion (formed from the Ultramark® 1022 reference compound) using a source filter with an $r/r_0$ ratio of 1.148 revealed that as the pressure in the source region increases, the boundary between instable and stable ion trajectories (i.e., the slope between 0 and 100% transmission efficiency) distorts and becomes shallower. At higher pressure, the ions will undergo increased collisional damping such that it becomes harder to remove unwanted ions from of the ion beam within the short duration of the source filter. A perfect ion filter will transmit 100% of the desired ions while rejecting 100% of the unwanted species. A broad transitional region indicates that it will be difficult to find such a discrete boundary at which we reject all the unwanted ions while retaining all the desired species. In this way, source filter performance is directly related to the slope of this transitional region. As the slope of this transitional region increases, so does the performance of the source filter. In this context, the pronounced negative relationship between source pressure and source filter performance for the standard $r/r_0$ ratio is concerning.

SUMMARY

Roughly described, embodiments of the present invention provide a source filter for use in m/z filtering of ions in a mass spectrometer. The source filter includes four elongated rod electrodes of circular cross-section extending from an inlet end to an outlet end. The rod electrodes are arranged into two electrode pairs, with each pair being opposed across a central axis of the source filter. The rod electrodes are sized and spaced such that, within a lateral cross section at any point along the central axis between the inlet end and the outlet end, the ratio $r/r_0$ of the rod electrode cross-sectional radius to the inscribed circle radius is less than unity. The source filter further includes a voltage supply for applying oscillatory and resolving DC voltages to the electrode pairs so as to effect m/z-selective transmission of ions.

By reducing the value of $r/r_0$ relative to prior art source filter designs, improved performance has been observed when the source filter is operated at relatively high pressure.

In more specific implementations, the value of $r/r_0$ of the source filter electrodes may be less than 0.8, or less than 0.6. Each of the rod electrodes may be of constant radius, or may have a radius that varies along the length of the electrodes. The rod electrodes may be arranged in mutually parallel relationship. The source filter may be located in a vacuum region that is maintained, during operation of the mass spectrometer, at a pressure above 75 milliTorr The source filter may also include an axial DC voltage supply configured to apply one or more DC voltages to the rod electrodes, or to auxiliary electrodes, to generate an axial DC filed that urges ion flow along the central axis of the source filter.

DETAILED DESCRIPTION OF EMBODIMENTS

In accordance with illustrative embodiments of the invention, a source filter is provided that exhibits improved performance in a high-pressure environment relative to prior art apparatus. Similarly to prior art source filters and other quadrupole mass filters, a source filter constructed in accordance with embodiments of the present invention includes four elongated rod electrodes disposed around a central axis, and arranged into electrode pairs, each pair being opposed across the central axis. However, the rod electrodes are sized and spaced such that value of the ratio $r/r_0$ is considerably reduced relative to the values used in prior art source filter designs.

Figure 2:
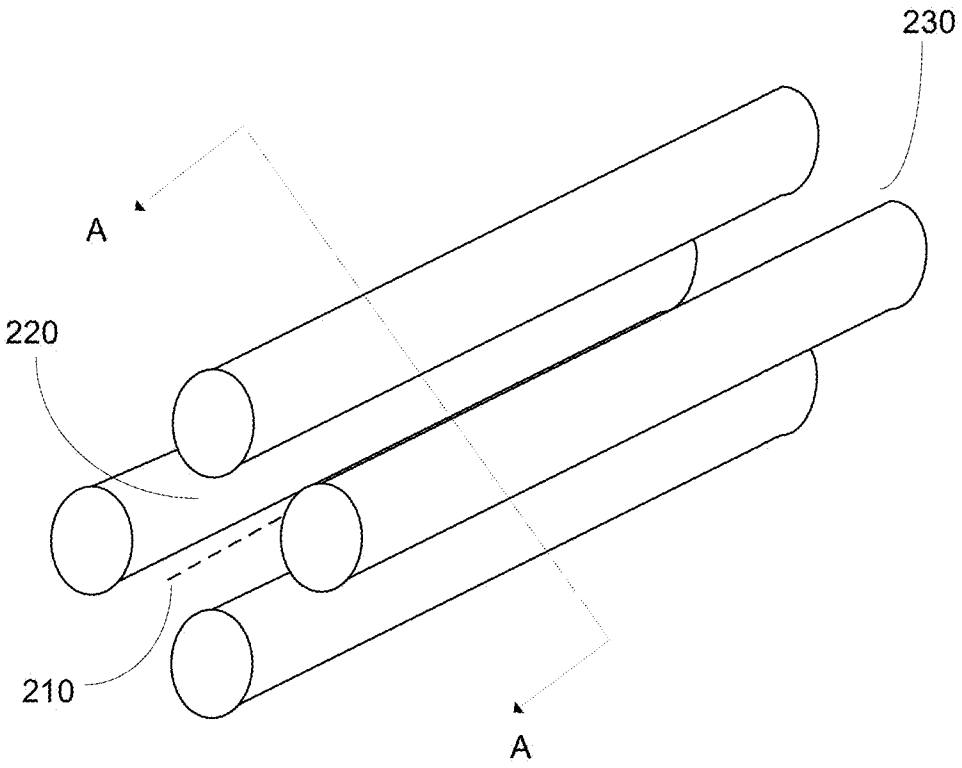
FIG. 2 depicts the rod electrodes of a source filter in perspective view.
Figure 3:
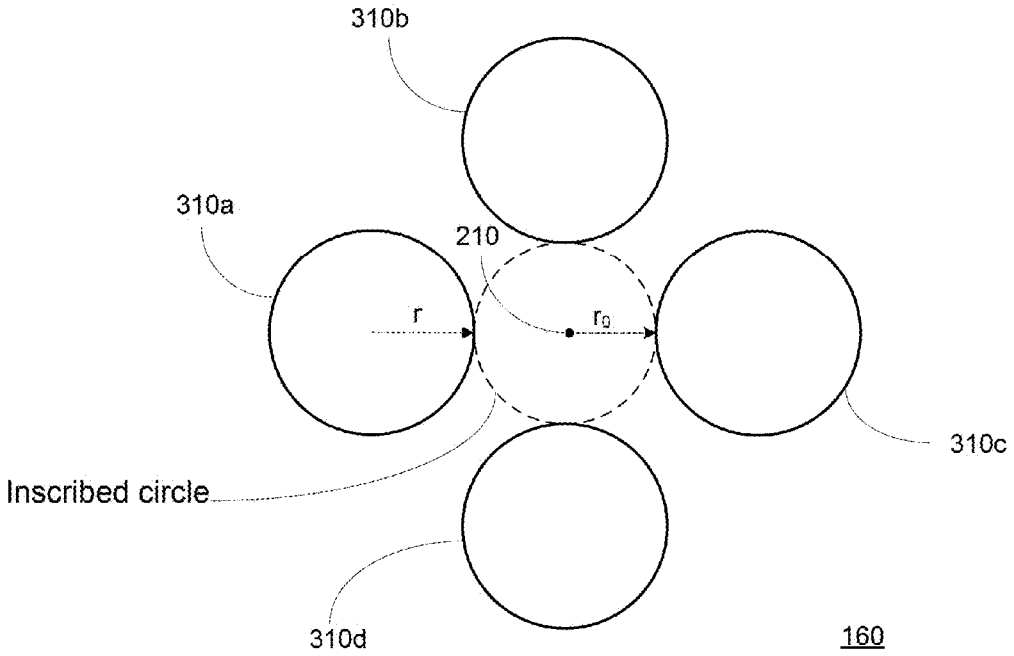
FIG. 3 is a cross-sectional view of the rod electrodes of a conventional source filter, taken in a lateral plane transverse to the source filter central axis.
Figure 4:
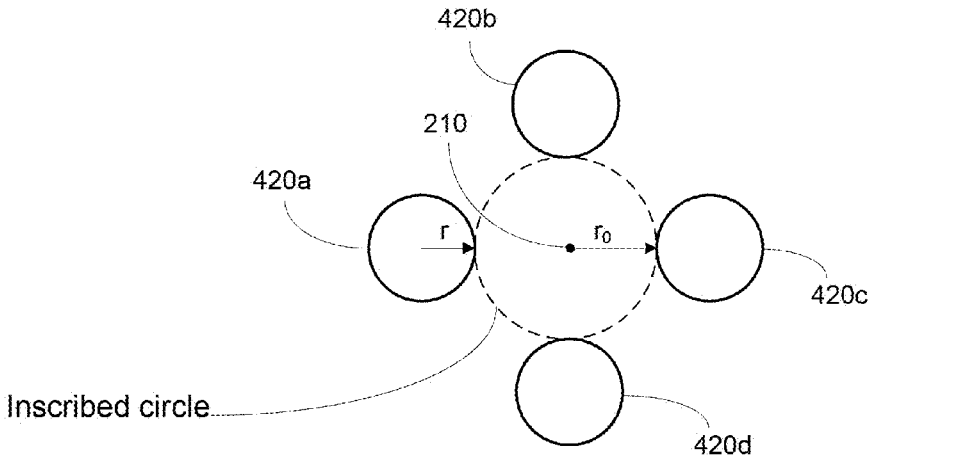
FIG. 4 is a cross-sectional view of the rod electrodes of a source filter having a significantly reduced ratio of rod electrode radius to inscribed circle radius ($r/r_0$), in accordance with an embodiment of the present invention.

FIG. 4 depicts in lateral cross-section (i.e., in a plane oriented perpendicular to the central axis), a source filter 410 that has a geometry and configuration similar to the prior art apparatus depicted in FIGS. 2 and 3, but with a significantly reduced $r/r_0$. This arrangement is sometimes referred to herein as an "open" configuration, in light of the relatively large interstitial regions between the rod electrodes. Similar to the FIG. 3 apparatus, each rod electrode 420*a-d* may be formed as an axially elongated cylinder of equal radius r, with each rod electrode positioned at an equal inscribed radius $r_0$ from the axial centerline. The rods may be arranged in radially opposed pairs such that the rod centers define a square. Again, as known in the art, RF and resolving DC voltages are applied to the rod electrodes (via connections to a voltage supply) such that one rod electrode pair (e.g., the pair consisting of rod electrodes 410*a,c*) receives a voltage of +(U−V cos ωt) and the other rod electrode pair (e.g., the pair consisting of rod electrodes 410*b,d*) receives a potential of −(U−V cos ωt), where U is the resolving DC component, and V is the amplitude of the RF voltage.

Figure 1:
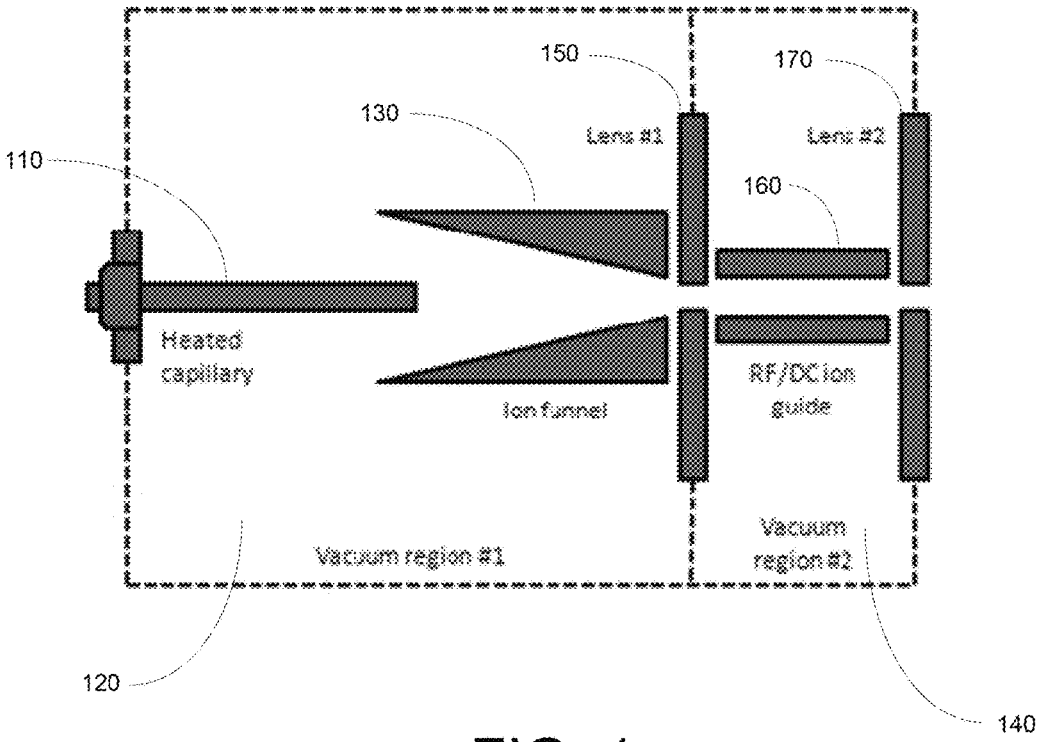
FIG. 1 depicts components in the source region of a mass spectrometer, including a source filter.
Figure 5:
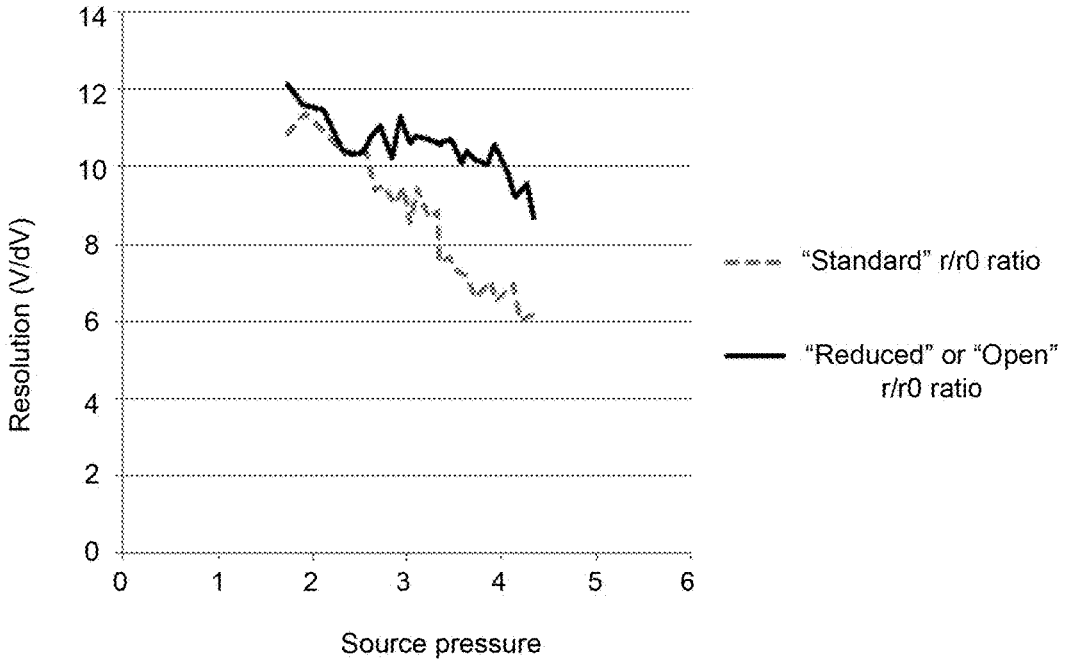
FIG. 5 is a graph showing the variation or resolution with source pressure for the conventional and reduced $r/r_0$ source filters.

In one (non-limiting) example, the source filter rod electrodes 410*a-d* each have a radius r of 1.56 mm, and the radius $r_0$ of the inscribed circle is 2.73 mm, yielding a $r/r_0$ ratio of 0.574 (approximately one-half of the established "optimal" ratio of 1.14-1.16). As will be discussed further below, it has been observed that by using an "open" source filter with electrodes of the aforementioned dimensions, the pronounced negative relationship between source pressure and filtering performance, which is typical of prior art source filter designs, is beneficially reduced. Generally, the stability boundaries of the ion transmission profiles for the reduced $r/r_0$ ratio source filter distort far less than the stability boundaries of the transmission profiles of the source filter with the "standard" $r/r_0$ ratio. FIG. 5 plots the measured transmission resolutions of these boundary regions as a function of source pressure, with the one data series representing the reduced $r/r_0$ source filter and the other data series representing the standard source filter. For the purposes of this figure, resolution is defined as the voltage at which 50% of the Ultramark 1022 m/z ions are transmitted divide by the difference in voltage between 25% and 75% transmission efficiency. For each ion transmission profile, positive and negative resolutions are averaged. It should be noted that the source pressures appearing in FIG. 5 are measured in the region immediately upstream to the region in which the source filter is located (e.g., vacuum region 120 in FIG. 1); however, the pressures within the second vacuum region in which the source filter is located vary proportionately with the measured pressures in the first vacuum region.

For both the source filter with the "standard" $r/r_0$ ratio and the source filter with the "open" $r/r_0$ ratio, we observe in FIG. 5 a negative relationship between source pressure and filter resolution. As the pressure increases, the resolution and overall performance of the filter decreases. However, this negative relationship is far less pronounced for the source filter with the "reduced/open" $r/r_0$ ratio. Modern mass spectrometers often have source pressures (pressures in the upstream region) that are greater than 3.5 Torr. In the high pressure range of 3.5-4 Torr the resolution and overall performance of the "open" $r/r_0$ ion guide is 20-50% better than the ion guide with the "standard" $r/r_0$ ratio.

While not intended to limit the present invention in any manner, three alternative explanations for the improved behavior of the reduced $r/r_0$ source filter at higher pressures are posited. In one scenario, the more "open" r/r0 ratio improves gas conductance away from the centerline of the ion guide. This in turn reduces the pressure in the region where ions are being filtered, which helps to alleviate the negative influence high gas pressures have on ion filter performance.

In another scenario, the addition of even-order multipole potentials (particularly the A6 and A10 field components) may produce a two-step excitation process. Ions entering the source filter will initially be dampened towards the center of the filter by the high background gas pressure. At these small radii the ions will primarily experience a quadrupolar field. As the ions become excited by the resolving DC, they will shift towards larger radii. As the radial displacement of the ions increase, the higher order multipole potentials will contribute more to the electric fields. These additive even-order multipole potentials should help constrain the ion beam. The result of this partial excitation process may be to "layer" the ion beam, with different m/z ions spread out over different radii. Thereby ions near the stability boundary of the source filter will experience less ion-ion interactions than if they had been confined to the center of the ion beam. Eventually as the ions are excited by the increased resolving DC, they will be ejected from the source filter. Space-charge effects could play a major role in the source region because modern mass spectrometers utilize very permissive ion sources with very bright ion beams.

In yet another scenario, as the ions are excited, the addition of the even-order multipole potentials shifts the ions towards higher frequencies, such that the ions behave as if they were effectively at higher q-values. In the case of the source filter describe herein, we are operating at very low q-values because the RF frequency is high and RF amplitude is low (ion q-values are typically less than 0.2). Unfortunately the resolution of the filter is directly related to the ion q-values. Ideally we would simply increase the ion q-values by increasing the amplitude of the RF voltage. However the pressures in the source region are high enough that large RF voltages might break down. By effectively shifting the ions to higher q-values with the addition of these higher order multipole potentials, we can enjoy the benefits of the higher q-values without risking a voltage breakdown.

It should be recognized that the benefits of the invention are not limited to the specific embodiments and examples described above, but may be realized in connection with reduced $r/r_0$ source filters of varying dimensions and configurations, and in different environments and settings. More particularly, although the example discussed above has an $r/r_0$ of 0.574, it is anticipated that substantial benefits may be achieved at higher and lower values of this parameter. Still more particularly, advantages may be realized with values of $r/r_0$ (at all points between the ion inlet and ion outlet ends) less than or equal to 0.6, less than or equal to 0.8, or less than or equal to unity. The lower limit of this ratio, which will still yield acceptable performance, is governed by the minimum electric field strength that produces adequate confinement and filtering of the ions, and will be a function of the RF and DC voltages, pressure and source filter length.

Furthermore, the improved source filter may be operated in regions having a range of sub-atmospheric pressures. More particularly, it is believed that (without limitation) the reduced $r/r_0$ source filter may be particularly advantageous when employed at sub-atmospheric pressures in excess of 75 milliTorr.

Still further, source filters constructed in accordance with the present invention may utilize a variety of rod electrode constructions and orientations. In the exemplary embodiment, the rod electrodes have a continuous cylindrical shape of fixed radius r, and are oriented in a mutually parallel relation such that $r_0$ is maintained constant along the entire length of the rod electrodes. In alternative embodiments, the rod electrodes may be constructed in a tapered frustroconical shape, such that the rod radius r varies along the length of the electrodes. In other embodiments, the rod electrodes (of fixed or varying radii) may be positioned in a tilted, non-parallel orientation with respect to each other. In such arrangements, the value of the $r/r_0$ ratio may vary along the length of the electrodes, or may alternatively (by the appropriate combination of tilting and tapering of rods) be maintained constant along the entire length.

In some embodiments, it may be useful to impose an axial DC field to urge the flow of ions toward the source filter exit and prevent ion stalling. The generation of an axial DC field may be accomplished using any one or combination of measures known in the art for this purpose, including but not limited to the use of auxiliary electrodes positioned in the interstitial spaces between adjacent rod electrodes, the application of a DC gradient along the rod electrode length (e.g., using different potentials applied to a resistive layer), tilting of the electrodes relative to one another, and axial segmentation of the rod electrodes with application of different DC voltages to different axial segments.

Finally, it will be understood that RF/DC filters having the features and characteristics described above (namely reduced $r/r_0$ ratio) may be used for applications other than those described above (i.e., filtering undesired ions before they reach and potentially foul downstream components), including for the purpose of crude (low-resolution) mass analysis.

What is claimed is:

1. A source filter for a mass spectrometer, comprising:

four elongated rod electrodes extending between an inlet end and an outlet end, the rod electrodes each being circular in cross section, the rod electrodes being arranged into first and second electrode pairs, each electrode pair having two rod electrodes opposed across a central axis of the source filter;

a voltage supply for applying oscillatory and resolving direct current (DC) voltages to the first and second electrode pairs;

wherein, within a lateral cross-sectional plane located at any point along the central axis between the inlet end and the outlet end, each of the rod electrodes has a radius of r and has an inner face located as a distance $r_0$ from the central axis, the value of $r/r_0$ being less than or equal to unity.

2. The source filter of claim 1, wherein the four rod electrodes are arranged in mutually parallel relationship.

3. The source filter of claim 1, wherein the rod radius r is constant from the inlet end to the outlet end.

4. The source filter of claim 1, wherein the rod radius r varies from the inlet end to the outlet end.

5. The source filter of claim 1, wherein the distance $r_0$ is constant from the inlet end to the outlet end.

6. The source filter of claim 1, wherein the distance $r_0$ varies from the inlet end to the outlet end.

7. The source filter of claim 1, wherein the value of $r/r_0$ is less than or equal to 0.8.

8. The source filter of claim 1, wherein the value of $r/r_0$ is less than or equal to 0.6.

9. The source filter of claim 1, wherein the value of $r/r_0$ varies with distance along the central axis.

10. The source filter of claim 1, wherein the source filter is located within a vacuum region, and wherein the vacuum region is maintained during operation at a pressure above 75 milliTorr.

11. The source filter of claim 1, further comprising an axial DC voltage supply for applying one or more DC voltages to the rod electrodes or to auxiliary electrodes to generate an axial DC field that urges ion flow along the central axis of the source filter.

* * * * *